US006398486B1

(12) United States Patent
Storey et al.

(10) Patent No.: US 6,398,486 B1
(45) Date of Patent: Jun. 4, 2002

(54) STEAM EXIT FLOW DESIGN FOR AFT CAVITIES OF AN AIRFOIL

(75) Inventors: James Michael Storey, Clifton Park, NY (US); Stephen William Tesh, Simpsonville, SC (US)

(73) Assignee: General Electric Company, Schnectady, NY (US)

( * ) Notice: Subject to any disclaimer, the term of this patent is extended or adjusted under 35 U.S.C. 154(b) by 0 days.

(21) Appl. No.: 09/585,840

(22) Filed: Jun. 1, 2000

(51) Int. Cl.[7] ..... F01D 9/06

(52) U.S. Cl. ..... 415/115; 415/114; 415/116; 416/96 A

(58) Field of Search ..... 415/114, 115, 415/116; 416/96 R, 96 A, 97 R

(56) References Cited

U.S. PATENT DOCUMENTS

| | | | | | |
|---|---|---|---|---|---|
| 4,379,677 | A | * | 4/1983 | Hallinger et al. | 415/116 |
| 5,145,315 | A | * | 9/1992 | North et al. | 415/115 |
| 5,217,347 | A | * | 6/1993 | Miracourt et al. | 415/115 |
| 5,253,976 | A | | 10/1993 | Cunha | |
| 5,320,483 | A | * | 6/1994 | Cunha et al. | 415/114 |
| 5,634,766 | A | | 6/1997 | Cunha et al. | |
| 5,685,693 | A | | 11/1997 | Sexton et al. | |

OTHER PUBLICATIONS

"39th GE Turbine State–of–the–Art Technology Seminar", Tab 1, "F"Technology—the First Half Million Operating Hours, H. E. Miller, Aug. 1996.

"39th GE Turbine State–of–the–Art Technology Seminar", Tab 2, "GE Heavy–Duty Gas Turbine Performance Characteristics", F. J. Brooks, Aug. 1996.

"39th GE Turbine State–of–the–Art Technology Seminar", Tab 3, "9EC 50Hz 170–MW Class Gas Turbine", A. S. Arrao, Aug. 1996.

"39th GE Turbine State–of–the–Art Technology Seminar", Tab 4, "MWS6001FA—An Advanced–Technology 70–MW Class 50/60 Hz Gas Turbine", Ramachandran et al., Aug. 1996.

"39th GE Turbine State–of–the–Art Technology Seminar", Tab 5, "Turbomachinery Technology Advances at Nuovo Pignone", Benvenuti et al., Aug. 1996.

"39th GE Turbine State–of–the–Art Technology Seminar", Tab 6, "GE Aeroderivative Gas Turbines—Design and Operating Features", M. W. Horner, Aug. 1996.

"39th GE Turbine State–of–the–Art Technology Seminar", Tab 7, "Advance Gas Turbine Materials and Coatings", P. W. Schilke, Aug. 1996.

(List continued on next page.)

*Primary Examiner*—Christopher Verdier
(74) *Attorney, Agent, or Firm*—Nixon & Vanderhye PC

(57) ABSTRACT

Turbine stator vane segments have inner and outer walls with vanes extending therebetween. The inner and outer walls have impingement plates. Steam flowing into the outer wall passes through the impingement plate for impingement cooling of the outer wall surface. The spent impingement steam flows into cavities of the vane having inserts for impingement cooling the walls of the vane. The steam passes into the inner wall and through the impingement plate for impingement cooling of the inner wall surface and for return through return cavities having inserts for impingement cooling of the vane surfaces. A skirt or flange structure is provided for shielding the steam cooling impingement holes adjacent the inner wall aerofoil fillet region of the nozzle from the steam flow exiting the aft nozzle cavities. Moreover, the gap between the flash rib boss and the cavity insert is controlled to minimize the flow of post impingement cooling media therebetween. This substantially confines outflow to that exiting via the return channels, thus furthermore minimizing flow in the vicinity of the aerofoil fillet region that may adversely affect impingement cooling thereof.

23 Claims, 9 Drawing Sheets

OTHER PUBLICATIONS

"39th GE Turbine State–of–the–Art Technology Seminar", Tab 8, "Dry Low $NO_x$ Combustion Systems for GE Heavy–Duty Turbines", L. B. Davis, Aug. 1996.
"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century H Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines, " J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th Ge Turbine State–of–the–Art Technology Seminar", Tab 19, "Monitoring Service Delivery System and Diagnostics", Jadej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Econonomic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug.1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., August 1996.
"39th GE Turbine State–of–the–Art Technology Seminar", Tab 38, "GE Combined Cycle Experience", Maskak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994–Aug. 31, 1995.
"Advanced Turbine Systems (ATS Program) Conceptual Design and Product Development", Final Technical Progress Report, vol. 2—Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999 Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Numbers DE–FC21–95MC31176–11.
"Exhibit panels used at 1995 product introduction at PowerGen Europe".

"Extensive Testing Program Validates High Efficiency, reliability of GE's Advanced "H" Gas Turbine Technology", Press Information, Press Release, 96–NR14, Jun. 26, 1996, H Technology Tests/pp. 1–4.

"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.

"Gas, Steam Turbine Work as Single Unit in GE's Advanced H Technology Combined–Cycle System", Press Information, Press Release, 95–NR18, May 16, 1995, Advanced Technology Introduction/pp. 1–3.

"GE Breaks 60% Net Efficiency Barrier" paper, 4 pages.

"GE Businesses Share Technologies and Experts to Develop State–of–the–Art Products", Press Information, Press Release 95–NR10, May 16, 1995, GE Technology Transfer/pp. 1–3.

"General Electric ATS Program Technical Review, Phase 2 Activities", T. Chance et al., pp. 1–4.

"General Electric's DOE/ATS H Gas Turbine Development" Advanced Turbine Systems Annual Review Meeting, Nov. 7–8, 1996, Washington D.C., Publication Release.

"H Technology Commercialization", 1998 MarComm Activity Recommendation, Mar. 1998.

"H Technology", Jon Ebacher, VP, Power Gen Technology, May 8, 1998.

"H Testing Process", Jon Ebacher, VP, Power Gen Technology, May 8, 1998.

"Heavy–Duty & Aeroderivative Products" Gas Turbines, Brochure, 1998.

"MS7001H/MS9001H Gas Turbine, gepower.com website for PowerGen Europe" Jun. 1–3 going public Jun. 15, (1995).

"New Steam Cooling System is a Key to 60% Efficiency for GE "H" Technology Combined–Cycle Systems", Press Information, Press Release, 95–NRR16, May 16, 1995, H Technology/pp. 1–3.

"Overview of GE's H Gas Turbine Combined Cycle", Jul. 1, 1995 to Dec. 31, 1997.

"Power Systems for the 21st Century—"H" Gas Turbine Combined Cycles", Thomas C. Paul et al., Report.

"Power–Gen '96 Europe", Conference Programme, Budspest, Hungary Jun. 26–28, 1996.

"Power–Gen International", 1998 Show Guide, Dec. 9–11, 1998, Orange County Convention Center, Orlando Florida.

"Press Coverage following 1995 product announcement", various newspaper clippings relating to improved generator.

"Proceedings of the Advanced Turbine Systems Annual Program Review Meeting", vol. I, "Industrial Advanced Turbine Systems Program Overview", D. W. Esbeck, pp. 3–13, Oct. 1995.

"Proceedings of the Advanced Turbine Systems Annual Program Review Meeting", vol. 1, "H Gas Turbine Combined Cycle", J. Corman, pp. 14–21, Oct. 1995.

"Proceedings of the Advanced Turbine Systems Annual Program Review Meetings", vol. 1, "Overview of Westinghouse's Advanced Turbine Systems Program", Bannister et al., pp. 22–30, Oct. 1995.

"Proceedings of the Advanced Turbine Systems Annual Program Review Meeting", vol. 1, "Allison Engine ATS Program Technical Review", D. Mukavetz, pp. 31–42, Oct. 1995.

"Proceedings of the Advanced Turbine Systems Annual Program Review Meeting", vol. 1, "Advanced Turbine Systems Program Industrial System Concept Development", S. Gates, pp. 43–63, Oct. 1995.

"Proceedings of the Advanced Turbine Systems Annual Program Review Meetings", vol. 1, "Advanced Turbine System Program Phase 2 Cycle Selection", Latcovich, Jr., pp. 64–69, Oct. 1995.

"Proceedings of the Advanced Turbine Systems Annual Program Review Meeting", vol. 1, "General Electric ATS Program Technical Review Phase 2 Activities", Chance et al., pp. 70–74, Oct. 1995.

"Proceedings of the Advanced Turbine Systems Annual Program Review Meeting", vol. 1, "Technical Review of Westinghouse's Advanced Turbine Systems Program", Diakunchak et al., pp. 75–86, Oct. 1995.

"Proceedings of the Advanced Turbine Systems Annual Program Review Meeting", vol. 1, "Advanced Combustion Turbines and Cycles: An EPRI Perspective," Touchton et al., pp. 87–88, Oct. 1995.

"Proceedings of the Advanced Turbine Systems Annual Program Review Meeting", vol. 1, "Advanced Turbine Systems Annual Program Review", William E. Koop, pp. 89–92, Oct. 1995.

"Proceedings of the Advanced Turbine Systems Annual Program Review Meeting", vol. 1, "The AGTSR Consortium: An Update", Fant et al., pp. 93–102, Oct. 1995.

"Proceedings of the Advanced Turbine Systems Annual Program Review Meeting", vol. 1, "Overview of Allison/AGTSR Interactions", Sy A. Ali, pp. 103–106, Oct. 1995.

"Proceedings of the Advanced Turbine Systems Annual Program Review Meeting", vol. 1, "Design Factors for Stable Lean Premix Combustion", Richards et al., pp. 107–113, Oct. 1995.

"Proceedings of the Advanced Turbine Systems Annual Program Review Meeting", vol. 1, "Ceramic Stationary as Turbine", M. van Roode, pp. 114–147, Oct. 1995.

"Proceedings of the Advanced Turbine Systems Annual Program Review Meeting", vol. 1, "DOE/Allison Ceramic Vane Effort", Wenglarz et al., pp. 148–151, Oct. 1995.

"Proceedings of the Advanced Turbine Systems Annual Program Review Meeting", vol. 1, "Materials/Manfacturing Element of the Advanced Turbine Systems Program", Karnitz et al., pp. 152–160, Oct. 1995.

"Proceedings of the Advanced Turbine Systems Annual Program Review Meeting", vol. 1, "Land–Based Turbine Casting Initiative", Mueller et al., pp. 161–170, Oct. 1995.

"Proceedings of the Advanced Turbine Systems Annual Program Review Meeting", vol. 1, "Turbine Airfoil Manufacturing Technology", Kortovich, pp. 171–181, Oct. 1995.

"Proceedings of the Advanced Turbine Systems Annual Program Review Meeting", vol. 1, "Pratt & Whitney Thermal Barrier Coatings", Bornstein et al., pp. 182–193, Oct. 1995.

"Proceedings of the Advanced Turbine Systems Annual Program Review Meeting", vol. 1, "Westinhouse Thermal Barrier Coatings", Goedjen et al., pp. 194–199, Oct. 1995.

"Proceedings of the Advanced Turbine Systems Annual Program Review Meeting", vol. 1, "High Performance Steam Development", Duffy et al., pp. 200–220, Oct. 1995.

"Proceedings of the Advanced Turbine Systems Annual Program Review Meeting", vol. 11, "Lean Premixed Combustion Stabilized by Radiation Feedback and heterogenous Catalysis", Dibble et al., pp. 221–232, Oct. 1995.

"Proceedings of the Advanced Turbine Systems Annual Program Review Meeting", vol. 11, "Rayleigh/Ramain/LIF Measurements in a Turbulent Lean Premixed Combustor", Nandula et al. pp. 233–248, Oct. 1995.

"Proceedings of the Advanced Turbine Systems Annual Program Review Meeting", vol. 11, "Functionally Gradient Materials for Thermal Barrier Coatings in Advanced Gas Turbine Systems", Banovic et al., pp. 276–280, Oct. 1995.

"Proceedings of the Advanced Turbine Systems Annual Program Review Meeting", vol. 11, "Advanced Turbine Cooling, Heat Transfer, and Aerodynamics Studies", Han et al., pp. 281–309, Oct. 1995.

"Proceedings of the Advanced Turbine Systems Annual Program Review Meeting", vol. 11, "Life Prediction of Advanced Materials for Gas Turbine Application", Zamrik et al., pp. 310–327, Oct. 1995.

"Proceedings of the Advanced Turbine Systems Annual Program Meeting", vol. 11, "Advanced Combustion Technologies for Gas Turbine Methodologies for Active Mixing and Combustion Control", Uri Vandsburger, pp. 123–156, Nov. 1996.

"Proceedings of the Advanced Turbine Systems Annual Program Meeting", vol. 11, "Combustion Modeling in Advanced Gas Turbine Systems", Smoot et al., pp. 353–370, Oct. 1995.

"Proceedings of the Advanced Turbine Systems Annual Program Meeting", vol. 11, "Heat Transfer in a Two–Pass Internally Ribbed Turbine Blade Coolant Channel with Cylindrical Vortex Generators", Hibbs et al. pp. 371–390, Oct. 1995.

"Proceedings of the Advanced Turbine Systems Annual Program Meeting", "Experimental and Computational Studies of Film Cooling With Cooling With Compound Angle Injection", Goldstein et al., pp. 423–451, Oct. 1995.

"Proceedings of the Advanced Turbine Systems Annual Program Meeting", vol. 11, "Rotational Effects on Turbine Blade Cooling", Govatzidakia et al., pp. 391–392, Oct. 1995.

"Proceedings of the Advanced Turbine Systems Annual Program Meeting", vol. 11, "Manifold Methods for Methane Combustion", Yang et al., pp. 393–409, Oct. 1995.

"Proceedings of the Advanced Turbine Systems Annual Program Meeting", vol. 11, "Advanced Multistage Turbine Blade Aerodynamics, Performance, Cooling, and Heat Transfer", Fleeter et al., pp. 410–414, Oct. 1995.

"Proceedings of the Advanced Turbine Systems Annual Program Meeting", vol. 11, The Role of Reactant Unmixedness, Strain Rate, and Length Scale on Premixed Combustor Performance, Samuelsen et al., pp. 415–422, Oct. 1995.

"Proceedings of the Advanced Turbine Systems Annual Program Meeting", vol. 11, "Compatibilty of Gas Turbine Materials with Steam Cooling", Desai et al., pp. 452–464, Oct. 1995.

"Proceedings of the Advanced Turbine Systems Annual Program Meeting", vol. 11, "Experimental and Computational Studies of Film Cooling With Compound Angle Injection", Goldstein et al., pp. 423–451, Oct. 1995.

"Proceedings of the Advanced Turbine Systems Annual Program Meeting", vol. 11, "Use of a Laser–Induced Fluorescence Thermal Imaging System for Film Cooling Heat Transfer Measurement", M. K. Chyu, pp. 465–473, Oct. 1995.

"Proceedings of the Advanced Turbine Systems Annual Program Meeting", vol. 11, Effects of Geometry on Slot–Jet Film Cooling Performance, Hyams et al., pp. 474–496, Oct. 1995.

"Proceedings of the Advanced Turbine Systems Annual Program Meeting", vol. 11, "Steam as Turbine Blade Coolant: Experimental Data Generation", Wilmsen et al., pp. 497–505, Oct. 1995.

"Proceedings of the Advanced Turbine Systems Annual Program Meeting", vol. 11, "Combustion Chemical Vapor Deposited Coatings for Thermal Barrier Coating Systems", Hampikian et al., pp. 506–515, Oct. 1995.

"Proceedings of the Advanced Turbine Systems Program Meeting", vol. 11, "Premixed Burner Experiments: Geometry, Mixing, and Flame Structure Issues", Gupta et al., pp. 516–528, Oct. 1995.

"Proceedings of the Advanced Turbine Systems Program Meeting", vol. 11, "Intercooler Flow Path for Gas Turbines: CFD Design and Experiments", Agrawal et al., pp. 529–538, Oct. 1995.

"Proceedings of the Advanced Turbine Systems Program Meeting", vol. 11, "Bond Strength and Stress Measurements in Thermal Barrier Coatings", Gell et al., pp. 539–549, Oct. 1995.

"Proceedings of the Advanced Turbine Systems Annual Program Review Meeting", vol. 11, "Active Control of Combustion Instabilities in Low $NO_x$ Gas Turbines", Zinn et al., pp. 550–551, Oct. 1995.

"Proceedings of the Advanced Turbine Systems Annual Program Review Meeting", vol. 11, "Combustion Instability Modeling and Analysis", Santoro et al., pp. 552–559, Oct. 1995.

"Proceedings of the Advanced Turbine Systems Annual Program Review Meeting", vol. 11, "Flow and Heat Transfer in Gas Turbine Disk Cavities Subject to Nonuniform External Pressure Field", Roy et al., pp. 560–565, Oct. 1995.

"Proceedings of the Advanced Turbine Systems Annual Program Review Meeting", vol. 11, "Heat Pipe Turbine Vane Cooling", Langston et al., pp. 566–572, Oct. 1995.

"Proceedings of the Advanced Turbine Systems Annual Program Review Meeting", vol. 11, "Improved Modeling Techniques for Turbomachinery Flow Fields", Lakshiminarayana et al., pp. 573–581, Oct. 1995.

"Proceedings of the Advanced Turbine Systems Annual Program Review Meeting","ATS and the Industries of the Future", Denise Swink, p. 1, Nov. 1996.

"Proceedings of the Advanced Turbine Systems Annual Program Meeting", vol. 11, "Advanced 3D Inverse Method for Designing Turbomachine Blades", T. Dang, p. 582, Oct. 1995.

"Proceedings of the Advanced Turbine Systems Annual Program Review Meeting", "Gas Turbine Association Agenda", William H. Day, pp. 3–16, Nov. 1996.

"Proceedings of the Advanced Turbine Systems Annual Program Review Meeting", "Power Needs in the Chemical Industry", Keith Davidson, pp. 17–26, Nov. 1996.

"Proceedings of the Advanced Turbine Systems Annual Program Review Meeting", "Advanced Turbine Systems Program Overview", David Esbeck, pp. 27–34, Nov. 1996.

"Proceedings of the Advanced Turbine Systems Annual Program Review Meeting", "Westinghouse's Advanced Turbine Systems Program", Gerard McQuiggan, pp. 35–48, Nov. 1996.

"Proceedings of the Advanced Turbine Systems Annual Program Review Meeting", "Overview of GE's H Gas Turbine Combined Cycle", Cook et al., pp. 49–72, Nov. 1996.

"Proceedings of the Advanced Turbine Systems Annual Program Review Meeting", "Allison Advanced Simple Cycle Gas Turbine System", William D. Weisbrod, pp. 73–94, Nov. 1996.

"Proceedings of the Advanced Turbine Systems Annual Program Review Meeting", "The AGTSR Industry–University Consortium", Lawrence P. Golan, pp. 95–110, Nov. 1996.

"Proceedings of the Advanced Turbine Systems Annual Program Review Meeting", "$No_x$ and CO Emissions Models for Gas–Fired Lean–Premixed Combustion Turbines", A. Mellor, pp. 111–122, Nov. 1996.

"Proceedings of the Advanced Turbine Systems Annual Program Review Meeting", "Methodologies for Active Mixing and Combustion Control", Uri Vandsburger, pp. 123–156, Nov. 1996.

"Proceedings of the Advanced Turbine Systems Annual Program Review Meeting", "Combustion Modeling in Advanced Gas Turbine Systems", Paul. O. Hedman, pp. 157–180, Nov. 1996.

"Proceedings of the Advanced Turbine Systems Annual Program Review Meeting", "Manifold Methods for Methane Combustion", Stephen B, Pope, pp. 181–188, Nov. 1996.

"Proceedings of the Advanced Turbine Systems Annual Program Review Meeting", "The Role Of Reactant Unmixedness, Strain Rate, and Length Scale on Premixed Combustor Performance", Scott Samuelsen pp. 189–210, Nov. 1996.

"Proceedings of the Advanced Turbine Systems Annual Program Review Meeting", "Effect of Swirl and Momentum Distribution on Temperature Distribution in Premixed Flames", Ashwani K. Gupta, pp. 211–232, Nov. 1996.

"Proceedings of the Advanced Turbine Systems Annual Progam Review Meeting", "Combustion Instability Studies Application to Land–Based Gas Turbine Combustors", Robert J. Santoro, pp. 233–252.

"Proceedings of the Advanced Turbine Systems Annual Program Review Meeting", "Combustion Instability Studies Application to Land–Based Gas Turbine Combustors", Robert J. Santoro, pp. 233–252.

"Proceedings of the Advanced Turbine Systems Annual Program Review Meeting", "Active Control of Combustion Instabilities in Low $NO_x$ Turbines", Ben. T. Zinn, pp. 253–264, Nov. 1996.

"Proceedings of the Advanced Turbine Systems Annual Program Review Meeting", "Life Prediction of Advanced Materials for Gas Turbine Application,"Sam Y. Zamrik, pp. 265–274, Nov. 1996.

"Proceedings of the Advanced Turbine Systems Annual Program Review Meeting", "Combustion Chemical Vapor Deposited Coatings for Thermal Barrier Coating Systems", W. Brent Carter, pp. 275–290, Nov. 1996.

"Proceedings of the Advanced Turbine Systems Annual Program Review Meeting", "Compatibility of Gas Turbine Materials with Steam Cooling", Vimal Desai, pp. 291–314, Nov. 1996.

"Proceedings of the Advanced Turbine Systems Annual Program Review Meeting", "Bond Strength and Stress Measurements in Thermal Barrier Coatings", Maurice Gell, pp. 315–334, Nov. 1996.

"Proceedings of the Advanced Turbine Systems Annual Program Review Meeting", "Advanced Multistage Turbine Blade Aerodynamics, Performance, Cooling and Heat Transfer", Sanford Fleeter, pp. 335–356, Nov. 1996.

"Proceedings of the Advanced Turbine Systems Annual Program Review Meeting", "Flow Characteristics of an Intercooler System for Power Generating Gas Turbines", Ajay K. Agrawal, pp. 357–370, Nov. 1996.

"Proceedings of the Advanced Turbine Systems Annual Program Review Meeting", "Improved Modeling Techniques for Turbomachinery Flow Fields", B. Lakshiminarayana, pp. 371–392, Nov. 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, pp. 393–406, Nov. 1996.

"Proceedings of the Advanced Turbine Systems Annual Program Review Meeting", "Advanced Turbine Cooling, Heat Transfer, and Aerodynamic Studies", Je–Chin Han, pp. 407–426, Nov. 1996.

"Proceedings of the Advaned Turbine Systems Annual Program Review Meeting", "Heat Transfer in a Two–Pass Internally Ribbed Turbine Blade Coolant Channel with Vortex Generators", S. Acharya, pp. 427–446.

"Proceedings of the Advanced Turbine Systems Annual Program Review Meeting", "Experimental and Computional Studies of Film Cooling with Compound Angle Injection", R. Goldstein, pp. 447–460, Nov. 1996.

"Proceedings of the Advanced Turbine Systems Annual Program Review Meeting", "Study of Endwall Film Cooling with a Gap Leakage Using a Thermographic Phosphor Flourescence Imaging System", Mingking K. Chyu, pp. 461–470, Nov. 1996.

"Proceedings of the Advanced Turbine Systems Annual Program Review Meeting", "Steam as a Turbine Blade Coolant: External Side Heat Transfer", Abraham Engeda, pp. 471–482, Nov. 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov. 1996.

"Proceedings of the Advanced Turbine Systems Annual Program Review Meeting", "Closed–Loop Mist/Steam Cooling for Advanced Turbine Systems", Ting Wang, pp. 499–512, Nov. 1996.

"Proceedings of the Advanced Turbine Systems Annual Program Review Meeting", "Heat Pipe Turbine Vane Cooling", Langston et al., pp. 513–534, Nov. 1996.

"Proceedings of the Advanced Turbine Systems Annual Program Review Meeting", "EPRI's Combustion Turbine Program: Status and Future Directions", Arthur Cohn, pp. 535–552, Nov. 1996.

"Proceedings of the Advanced Turbine Systems Annual Program Review Meeting", "ATS Materials Support", Michael Karnitz, pp. 553–576, Nov. 1996.

"Proceedings of the Advanced Turbine Systems Annual Program Review Meeting", "Land Based Turbine Casting Initiative", Boyd A. Mueller, pp. 577–592, Nov. 1996.
"Proceedings of the Advanced Turbine Systems Annual Program Review Meeting", "Turbine Airfoil Manufacturing Technology", Charles S. Kortovich, pp. 593–622, Nov. 1996.
"Proceedings of the Advanced Turbine Systems Annual Program Review Meeting", "Hot Corrosion Testing of TBS's, Norman Bornstein", pp. 623–658, Nov. 1996.
"Proceedings of the Advanced Turbine Systems Annual Program Review Meeting", "Ceramic Stationary Gas Turbine", Mark van Roode, pp. 633–658, Nov. 1996.
"Proceedings of the Advanced Turbine Systems Annual Program Review Meeting", "Western European Status of Ceramics for Gas Turbines", Tibor Bornemisza, pp. 659–670, Nov. 1996.
"Proceedings of the Advanced Turbine Systems Annual Program Review Meeting", "Status of Ceramic Gas Turbines in Russia", Mark van Roode, p. 671, Nov. 1996.
"Status Report: The U.S. Department of Energy's Advanced Turbine systems Program", facsimile dated Nov. 7, 1996.
"Testing Program Results Validate GE's H Gas Turbine–High Efficiency, Low Cost of Electricity and Low Emissons", Roger Schonewald and Patrick Marolda, (no date available).
"Testing Program Results Validate GE's H Gas Turbine –High Efficiency, Low Cost of Electricity and Low Emissions", Slide Presentation –working draft, (no date available).
"The Next Step in H . . . For Low Cost Per kW–Hour Power Generation", LP–1 PGE'98.
"Utility Advanced Turbine System (ATS) Technology Readiness Testing and Pre–Commercialization Demonstration", Document #486040, Oct. 1 –Dec. 31, 1996, Publication Date, Jun. 1, 1997, Report Numbers: DOE/MC/31176–5628.
"Utility Advanced Turbine System (ATS) Technology Readiness Testing —Phase 3", Document #666274, Oct. 1, 1996–Sep. 30, 1997, Publication Date, Dec. 31, 1997, Report Numbers: DOE/MC/31176–10
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Numbers: DOE/MC/31176–5340.
"Utility Advanced Turbine System (ATS) Technology Readiness Testing And Pre–Commerical Demonstration–Phase 3", Document #486132, Apr. 1 –Jun. 30, 1976, Publication Date, Dec. 31, 1995, Report Numbers: DOE/MC/31176–5660.
"Utility Advanced Turbine System (ATS) Technology Readiness Testing and Pre–Commerical Demonstration Phase 3", Document #587906, Jul. 1 –Sep. 30, 1995, Publication Date, Dec. 31, 1995 Report Numbers: DOE/MC/31176–5339.
"Utlilty Advanced Turbine System (ATS) Technology Readiness Testing and Pre–Commerical Demonstration Document" #666277, Apr. 1 –Jun 30, 1997, Publication Date, Dec. 31, 1997, Report Numbers: DOE/MC/31176–8.
"Utility Advanced Turbine System (ATS) Technology Readiness Testing and Pre–Commercialization Demonstration" Jan. 1 –Mar. 31, 1996, DOE/MC/31176–5338.
"Utility Advanced Turbine Systems (ATS) Technology Readiness Testing: Phase 3R", Document #756552, Apr. 1 –Jun. 30, 1999, Publication Date, Aug. 1, 1998, Report Numbers: FC21–95MC31176–23.
"Utility Advanced Turbine Systems (ATS) Technology Readiness Testing.", Document #656823, Jan. 1 –Mar. 31, 1998, Publications Date, Aug. 1, 1998, Report Numbers: DOE/MC/31176–17.
"Utility Advanced Turbine Systems (ATS) Technology Readiness Testing and Pre–Commercial Demonstration", Annual Technical Progress Report Period: Jul. 1, 1995 –Sep. 30, 1996.
"Utility Advanced Turbine Systems (ATS) Technology Readiness Testing", Document #750405, Oct. 1 –Dec. 30, 1998, Publication Date: May 1, 1999, Report Numbers: DE–FC21–95MC31176–20.
"Utility Advanced Turbine Systems (ATS) Technology Readiness Testing", Document #1348, Apr. 1 –Jun. 29, 1998, Publication Date Oct. 29, 1998, Report Numbers DE–FC21MC31176–18.
"Utlilty Advanced Turbine Systems (ATS) Technology Readiness Testing –Phase 3", Annual Technical Progress Report, Reporting Period: Oct. 1, 1996 –Sep. 30, 1997.
"Utility Advanced Turbine Systems (ATS) Technology Readiness Testing and Pre–Commercial Demonstration", Quarterly Report, Jan. 1 –Mar. 31, 1997, Document #666275, Report Numbers: DOE/MC/31176–07.
"Proceedings of the 1997 Advanced Turbine Systems", Annual Review Meeting, Oct. 26–29, 1997.

* cited by examiner

STEAM EXIT FLOW DESIGN FOR AFT CAVITIES OF AN AIRFOIL

This invention was made with Government support under Contract No. DE-FC21-95MC31176 awarded by the Department of Energy. The Government has certain rights in this invention.

BACKGROUND OF THE INVENTION

The present invention relates generally to gas turbines, for example, for electrical power generation, and more particularly to cooling circuits for the first nozzle stage of a turbine.

The traditional approach for cooling turbine blades and nozzles is to extract high pressure cooling air from a source, for example, from the intermediate and last stages of the turbine compressor. A series of internal flow passages are typically used to achieve the desired mass flow objectives for cooling the turbine blades. In contrast, external piping is used to supply air to the nozzles, with air film cooling typically being used and the air exiting into the hot gas stream of the turbine. In advanced gas turbine designs, it has been recognized that the temperature of the hot gas flowing past the turbine components could be higher than the melting temperature of the metal. It is therefore necessary to establish a cooling scheme to more assuredly protect the hot gas path components during operation. Steam has been demonstrated to be a preferred cooling media for cooling gas turbine nozzles (stator vanes), particularly for combined-cycle plants. See, for example, U.S. Pat. No. 5,253,976, the disclosure of which is incorporated herein by this reference. However, because steam has a higher heat capacity than the combustion gas, it is inefficient to allow the coolant steam to mix with the hot gas stream. Consequently, it is desirable to maintain cooling steam inside the hot gas path components in a closed circuit. Certain areas of the components of the hot gas path, however, cannot practically be cooled with steam in a closed circuit. For example, the relatively thin structure of the trailing edges of the nozzle vanes effectively precludes steam cooling of those edges. Therefore, air cooling may be provided in the trailing edges of nozzle vanes. For a complete description of the steam cooled nozzles with air cooling along the trailing edge, reference is made to U.S. Pat. No. 5,634,766, the disclosure of which is incorporated herein by reference.

BRIEF SUMMARY OF THE INVENTION

The present invention provides a cooling system for cooling the hot gas components of a nozzle stage of a gas turbine, in which closed circuit steam or air cooling and/or open circuit air cooling systems may be employed. In the closed circuit system, a plurality of nozzle vane segments are provided, each of which comprises one or more nozzle vanes extending between inner and outer walls. The vanes have a plurality of cavities in communication with compartments in the outer and inner walls for flowing cooling media in a closed circuit for cooling the outer and inner walls and the vanes per se. This closed circuit cooling system is substantially structurally similar to the steam cooling system described and illustrated in the prior referenced U.S. Pat. No. 5,634,766, with certain exceptions as noted below. Thus, cooling media is provided to a plenum in the outer wall of the segment for distribution therein and passage through impingement openings in a plate for impingement cooling of the outer wall surface of the segment. The spent impingement cooling media flows into leading edge and aft cavities extending radially through the vane. Return intermediate cooling cavities extend radially and lie between the leading edge and aft cavities. A separate trailing edge cavity may also be provided. The cooling media that flows through the leading edge and aft cavities flows into a plenum in the inner wall and through impingement openings in an impingement plate for impingement cooling of the inner wall of the segment. The spent impingement cooling media then flows through the intermediate return cavities for further cooling of the vane.

Impingement cooling is also provided in the leading and aft cavities of the first stage nozzle vane, as well as in the intermediate, return cavities of the vane. Inserts in the leading and aft cavities comprise sleeves having a collar at their inlet ends for connection with integrally cast flanges in the outer wall of the cavities and extend through the cavities spaced from the walls thereof. These inserts have impingement holes in opposition to the walls of the cavity whereby steam flowing into the inserts flows outwardly through the impingement holes for impingement cooling of the vane walls. Return or exit channels are provided along the inserts for channeling the spent impingement cooling steam. Similarly, inserts in the return intermediate cavities have impingement openings for flowing impingement cooling medium against the side walls of the vane. These inserts also have return or exit channels for collecting the spent impingement cooling steam and conducting it to the steam outlet.

As post impingement steam flow exits the aft cavities, it has conventionally experienced an expansion into the plenum-type cavity of the inner wall that is defined by the surface of the inner wall impingement plate. The impingement plate is curved to be disposed generally in parallel to the fillet region of the aerofoil. Thus, the impingement holes of the impingement plate in this region of the aerofoil fillet are oriented such that their center lines are perpendicular to the surface of the fillet. However, this also places many of these holes generally perpendicular to the flow exiting from the aft cavities. Accordingly, the problem exists that the cooling media, such as steam flow, exiting the aft cavities can adversely affect the performance of the steam cooling impingement holes in this region by creating an unstable, low static pressure steam supply to those holes.

The present invention was developed in particular for the purposes of steam cooling robustness in the area of the aerofoil fillet of the stage one nozzle.

The invention is thus embodied in structures that allow for the steam flow to exit the aft cavities in a manner which substantially isolates the same from the impingement holes in the vicinity of the exit of these cavities. This prevents the inner wall and aerofoil fillet impingement holes from receiving an unpredictable steam supply from the aft cavities.

The invention relates in particular to the configuration of the cavity insert and the flash rib configuration at the radially inner end of the first stage nozzle. More specifically, according to a first aspect of the invention, the invention is embodied in an extending flange or skirt to channel exit flow from the respective insert to isolate the same from impingement openings in the vicinity of the cavity exit ends. In a first embodiment, a flash rib boss is defined peripherally of at least one of the aft cavities and a flange or skirt extends radially inwardly from the boss. The skirt, which extends from the impingement boss, channels the flow exiting the corresponding aft vane cavity into the plenum radially inwardly of the impingement plate while shielding the impingement holes in the vicinity of that vane cavity from an adverse influence from the exiting steam flow.

In a second, alternate embodiment of the invention, the fin of the cavity insert for at least one of the aft cavities is extended in a radial direction, longitudinally of the insert so as to define a flange to channel the exit flow generally to an area beyond the fillet region and thereby substantially preclude an adverse effect on the impingement cooling in the vicinity of the cavity. Thus, in this embodiment, the fins of the cavity insert are extended to act as flow directing skirts which shield the impingement holes adjacent the cavity and the nozzle inner side wall.

A second aspect of the invention relates to the configuration of the interface between the cavity insert and the flash rib boss at the radially inner end of the first stage nozzle. More specifically, according to a second aspect of the invention, a gap between a flash rib or impingement boss, provided at the juncture of the impingement plate and the flash rib, and the cavity insert is controlled to minimize flow therebetween, so that flow out of the cavities is substantially limited to the flow out of the return or exit channel(s), where it will have a lesser impact on the impingement cooling of the aerofoil fillet region. In a presently preferred embodiment of the invention, the insert body defines a controlled gap with the flash rib boss irrespective of the location of the flange or skirt-like extension structure. The gap is most preferably controlled to about 0.02 inches.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
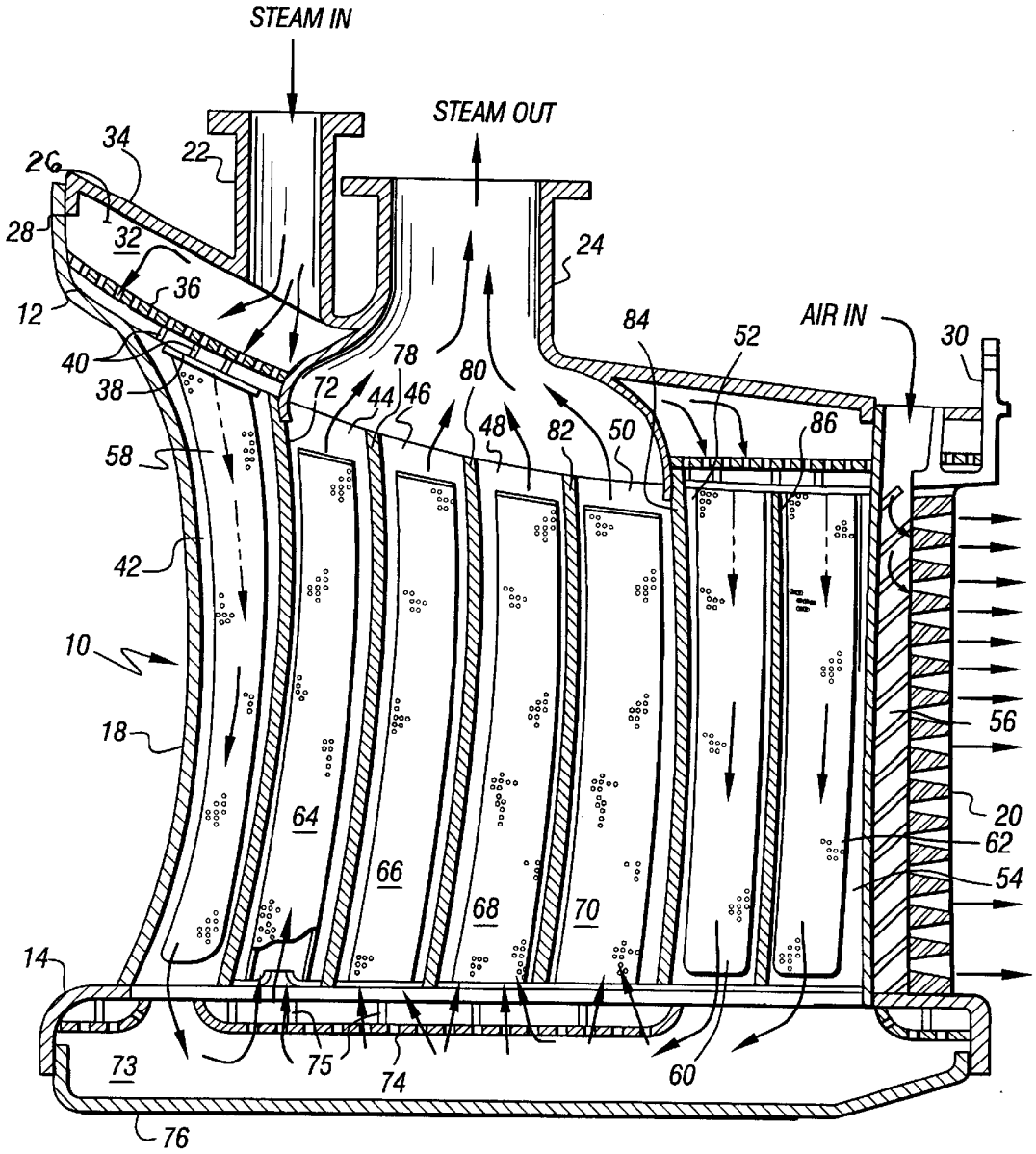
FIG. 1 is a schematic cross-sectional view of a first stage nozzle vane in which a cooling media exit flow skirt structure embodying the invention may be provided.

As discussed previously, the present invention relates in particular to cooling circuits for the first stage nozzles of a turbine, reference being made to the previously identified patents for disclosures of various other aspects of the turbine, its construction and methods of operation. Referring now to FIG. 1, there is schematically illustrated in cross-section a vane 10 comprising one of the plurality of circumferentially arranged segments of the first stage nozzle. It will be appreciated that the segments are connected one to the other to form an annular array of segments defining the hot gas path through the first stage nozzle of the turbine. Each segment includes radially spaced outer and inner walls 12 and 14, respectively, with one or more of the nozzle vanes 10 extending between the outer and inner walls. The segments are supported about the inner shell of the turbine (not shown) with adjoining segments being sealed one to the other. It will therefore be appreciated that the outer and inner walls and the vanes extending therebetween are wholly supported by the inner shell of the turbine and are removable with the inner shell halves of the turbine upon removal of the outer shell as set forth in U.S. Pat. No. 5,685,693. For purposes of this description, the vane 10 will be described as forming the sole vane of a segment.

As shown in the schematic illustration of FIG. 1, the vane has a leading edge 18, a trailing edge 20, and a cooling steam inlet 22 to the outer wall 12. A return steam outlet 24 also lies in communication with the nozzle segment. The outer wall 12 includes outer side railings 26, a leading railing 28, and a trailing railing 30 defining a plenum 32 with the outer cover plate 34 and an impingement plate 36 disposed in the outer wall 12. (The terms outwardly and inwardly or outer and inner refer to a generally radial direction). Disposed between the impingement plate 36 and the inner surface 38 of outer wall 12 are a plurality of structural ribs 40 extending between the side walls 26, forward wall 28 and trailing wall 30. The impingement plate 36 overlies the structural ribs 40 throughout the full extent of the plenum 32. Consequently, steam entering through inlet port 22 into plenum 32 passes through the openings in the impingement plate 36 for impingement cooling of the inner surface 38 of the outer wall 12.

In this exemplary embodiment, the first stage nozzle vane 10 has a plurality of cavities, for example, a leading edge cavity 42, two aft cavities 52, 54, four intermediate return cavities 44, 46, 48 and 50, and also a trailing edge cavity 56.

As illustrated in FIG. 1, the post-impingement cooling steam flows into a plenum 73 defined by the inner wall 14 and a lower cover plate 76. Structural ribs 75 are integrally cast with the inner wall 14. Radially inwardly of the structural ribs 75 is an impingement plate 74. As a consequence, it will be appreciated that the spent impingement cooling steam flowing from cavities 42, 52, and 54 flows into the plenum 73 for flow through the impingement openings of impingement plate 74 for impingement cooling of the inner wall 14. The spent cooling steam flows by direction of the ribs 75 towards the openings (not shown in detail) for return flow through the cavities 44, 46, 48, and 50, respectively, to the steam outlet 24. Insert sleeves 64, 66, 68, and 70 are disposed in the cavities 44, 46, 48, and 50 in spaced relation from the side walls 88, 90 and partition walls 72, 78, 80, 82, 84, defining the respective cavities. The impingement openings lie on opposite sides of the sleeves for flowing the cooling media, e.g., steam, from within the insert sleeves through the impingement openings for impingement cooling of the side walls 88, 90 of the vane, as generally discussed above. The spent cooling steam then flows from the gaps between the insert sleeves and the walls of the intermediate cavities to outlet 24 for return to the coolant, e.g., steam, supply.

The air cooling circuit of the trailing edge cavity 56 of the combined steam and air cooling circuit of the vane illustrated in FIG. 1 generally corresponds to that of the '766 patent and, therefore, a detailed discussion herein is omitted.

Figure 4:
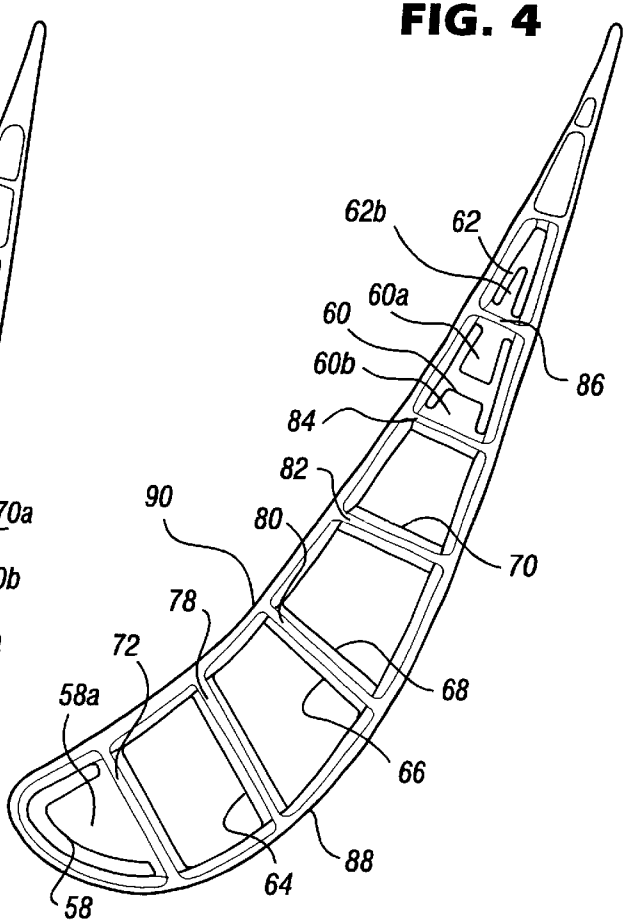
FIG. 4 is a schematic cross-sectional view similar to FIGS. 2 and 3 showing exemplary insert configurations adjacent the radially inner end of the vane.
Figure 3:
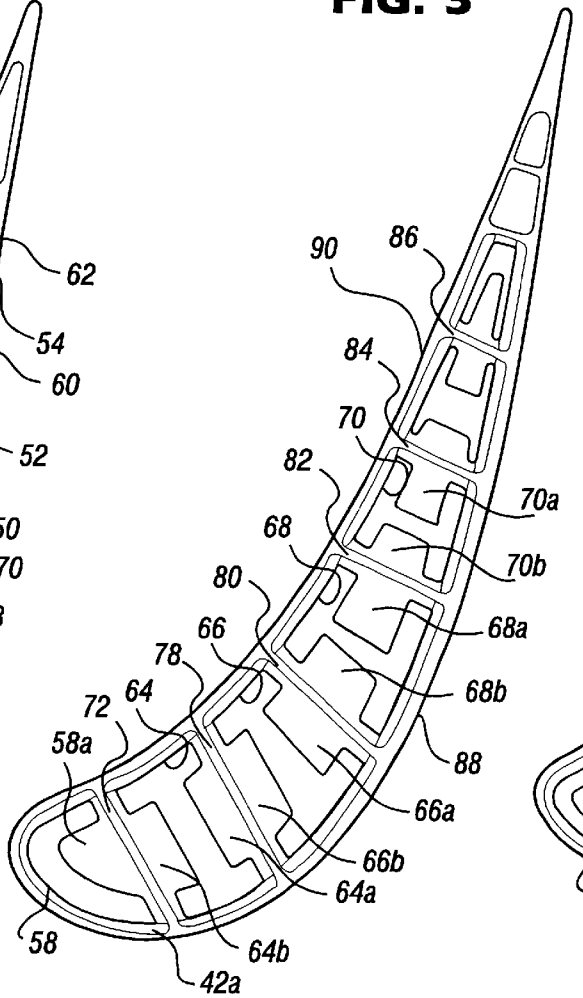
FIG. 3 is a schematic cross-sectional view similar to FIG. 2 showing the configuration of the cavity inserts mid span of the vane.
Figure 2:
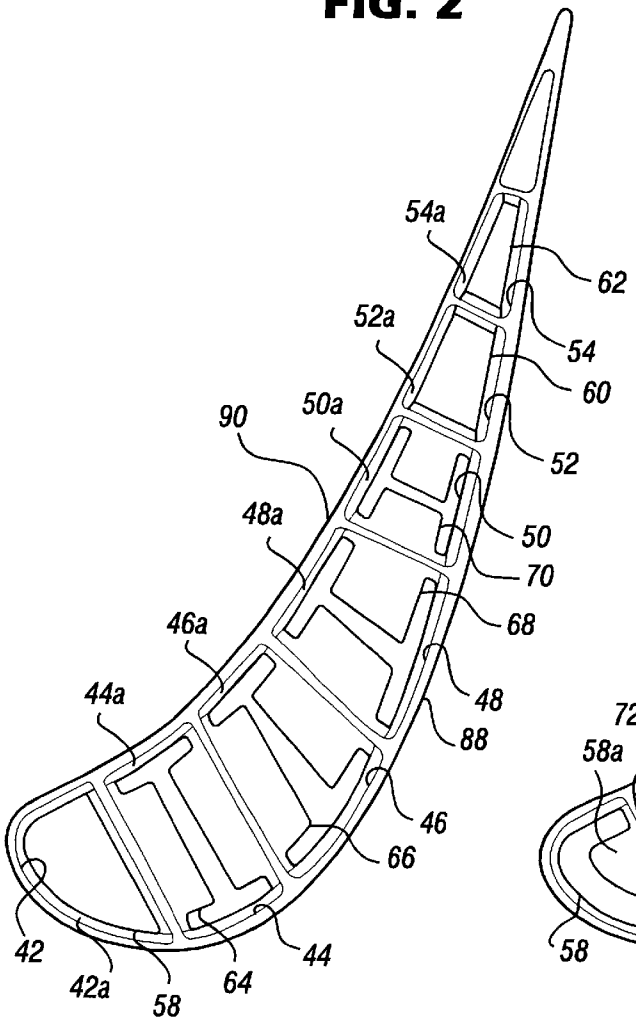
FIG. 2 is a schematic cross-sectional view of the first stage nozzle vane, adjacent the radially outer end thereof.

Referring to the nozzle vane structure shown in FIGS. 2–4, in the illustrated, exemplary embodiment, seven cavities are provided for cooling steam flow. The first, leading edge cavity 42 and the aft, sixth and seventh cavities 52, 54 are down-flow cavities in this embodiment. The second through fifth cavities 44, 46, 48, 50, on the other hand, are up-flow, steam return intermediate cavities. As mentioned above, each of the steam flow cavities in this embodiment is provided with a respective cavity insert. Thus, the leading edge cavity 42 and aft cavities 52, 54 each have an insert sleeve, 58, 60, and 62, respectively, while each of the intermediate cavities 44, 46, 48 and 50 have similar insert sleeves 64, 66, 68, and 70, respectively, all such insert sleeves being in the general form of hollow sleeves, having perforations as described in greater detail herein below. The insert sleeves are preferably shaped to correspond to the shape of the particular cavity in which the insert sleeve is to be provided and sides of the sleeves are provided with a plurality of impingement cooling openings, along portions of the insert sleeve which lie in opposition to the walls of the cavity to be impingement cooled. For example, as shown in FIG. 2, in the leading edge cavity 42, the forward edge of the insert sleeve 58 would be arcuate and the side walls would generally correspond in shape to the side walls of the cavity 42, with such walls of the insert sleeve having impingement openings along the length thereof. The back side of the sleeve or insert sleeve 58, disposed in opposition to the partition wall 72 separating cavity 42 from cavity 44, however, would not have impingement openings. Similarly, in the aft cavities 52, 54, the side walls of the insert sleeves 60 and 62 have impingement openings along the length thereof, whereas the forward and aft walls of insert sleeves 60 and 62, facing cavity defining partition walls 84 and 86, for example, are of a solid non-perforated material.

It will be appreciated that the insert sleeves received in cavities 42, 44, 46, 48, 50, 52, and 54 are spaced from the walls of the cavities to enable cooling media, e.g., steam, to flow through the impingement openings to impact against the interior wall surfaces of the cavities, hence cooling the wall surfaces. In the illustrated embodiment, the inserts are spaced from the walls of the cavities, by cavity ribs, schematically shown at 42*a*, 44*a*, 46*a*, 50*a*, 52*a*, and 54*a*. To minimize degradation of the cooing impingement flow downstream, the cavity ribs further direct the steam to the return or exit channel(s) 58*a*, 60*b*, 60*a*, 62*b*, 64*b*, 64*a*, 66*b*, 66*a*, 68*b*, 68*a*, 70*b*, 70*a*, defined in the illustrated embodiment between the imperforate walls of the inserts and the respective cavity walls 72, 84, 86, 78, 80, 82.

To accommodate the ever increasing volume of post-impingement flow, the inserts have a transitioning or profile changing configuration. Thus, for example, with reference to the leading edge cavity, the cavity insert is substantially D-shaped at the radial outer end of the vane, where the cooling media first enters this cavity (FIG. 2). The cooling media flows through impingement holes (not shown in this view) to impinge upon the vane outer walls to impingement cool the same. The cavity ribs 42*a* defined at spaced locations along the length of the cavity 42 encourage this spent cooling steam to flow in a chord-wise direction to be collected at the aft dump channel 58*a* of the leading edge cavity insert, as shown in FIGS. 3 and 4. As illustrated, progressing radially inwardly along the vane, the aft dump channel 58*a* of this insert 58 increases in dimension as the spent cooling medium flow volume increases relative to the remaining cooling flow that has yet to flow out through the impingement holes in the insert. Thus, along the length of the vane, the insert 58 of the leading edge cavity 42 changes profile from a generally D-shape to a generally C-shape. The aft down-flow cavities 52, 54 similarly define a gradually transitioning configuration in the direction of flow as shown by comparison of FIGS. 2, 3 and 4. In this example, the insert 60 in aft cavity 52 transitions from a generally rectangular profile to an H-shaped profile, and the insert 62 in aft cavity 54 transitions from a generally triangular or narrow edged rectangular profile to a generally V-shaped profile.

Similarly, the up-flow cavities define a maximum insert dimension at the radially inner end of the vane (FIG. 4) and define progressively changing cross-sectional configurations. Thus, at the radially inner end of the vane, these inserts 64, 66, 68, 70 are generally rectangular. However, as the aft and forward dump channels 64*a*, 64*b*; 66*a*, 66*b*; 68*a*, 68*b*; 70*a*, 70*b* gradually increase in size along the flow direction of the cooling media, the cavities assume what might be characterized as an H or I beam shape. In these cavities as well, cavity ribs 44*a*, 46*a*, 48*a*, 50*a* are defined at spaced locations along the length of the respective cavity to space the inserts from the vane wall and to encourage spend cooling medium to flow in a chord-wise direction to the forward and aft dump channels.

Figure 5:
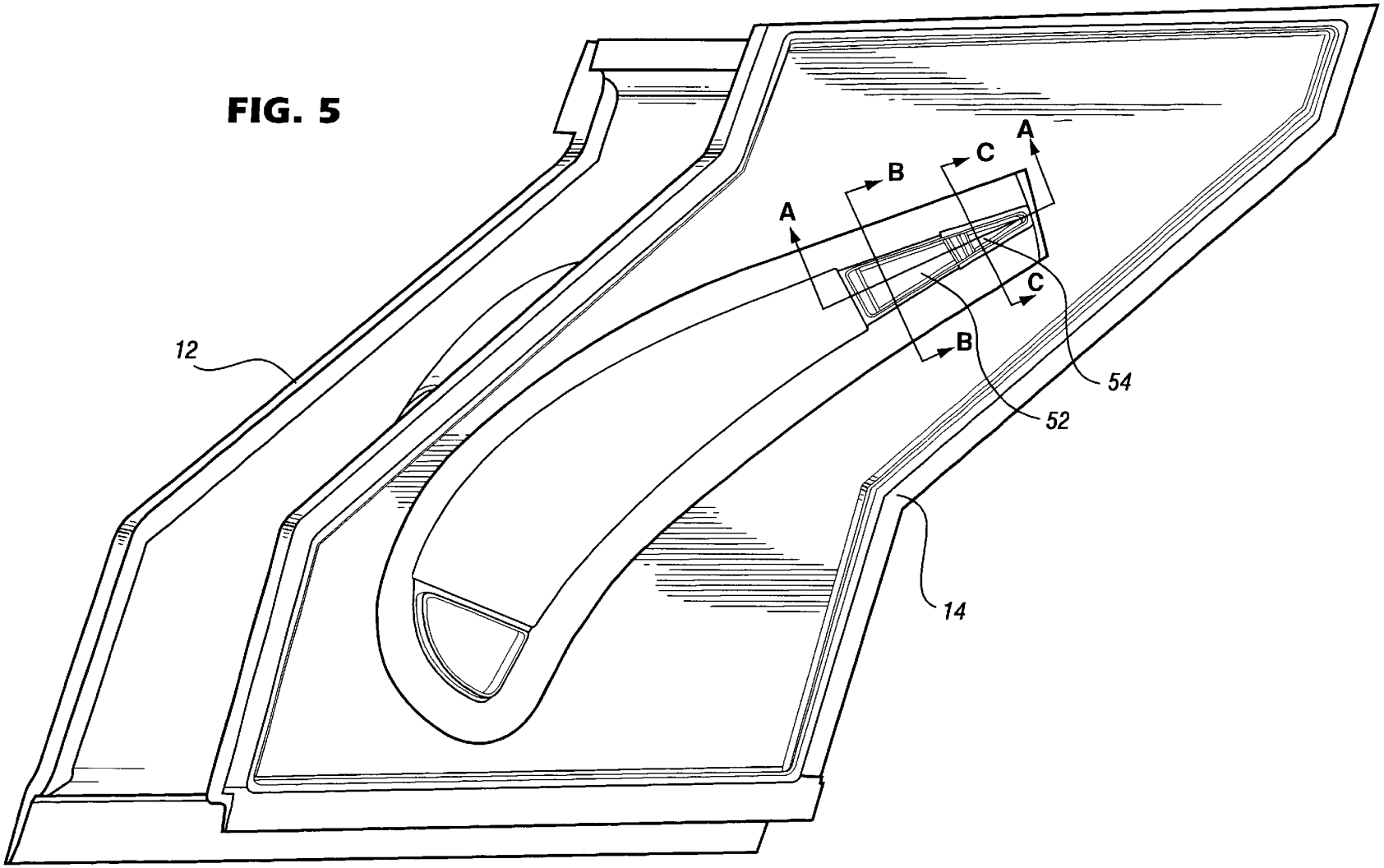
FIG. 5 is a schematic perspective view of a first stage nozzle vane segment taken from the radially inner end of the vane segment.

As noted above, the present invention was developed in particular for the purposes of steam cooling robustness in the area of the aerofoil fillet of the stage one nozzle vanes. Thus, the invention relates in particular to the configuration of the cavity insert and the flash rib configuration at the radially inner end of the vanes of the first stage nozzle. FIG. 5 is a perspective view of the radially inner end of the nozzle vane segment, with details of the intermediate, return cavities and inserts omitted for clarity. As described more particularly below, the invention is embodied in an extension defined at the radially inner end of the sixth and seventh cavities, in particular, to channel exit flow from the respective inserts, to shield the steam cooling impingement holes adjacent the inner wall aerofoil fillet region 92 of the nozzle from the steam flow exiting these aft nozzle cavities 52, 54.

Figure 6:
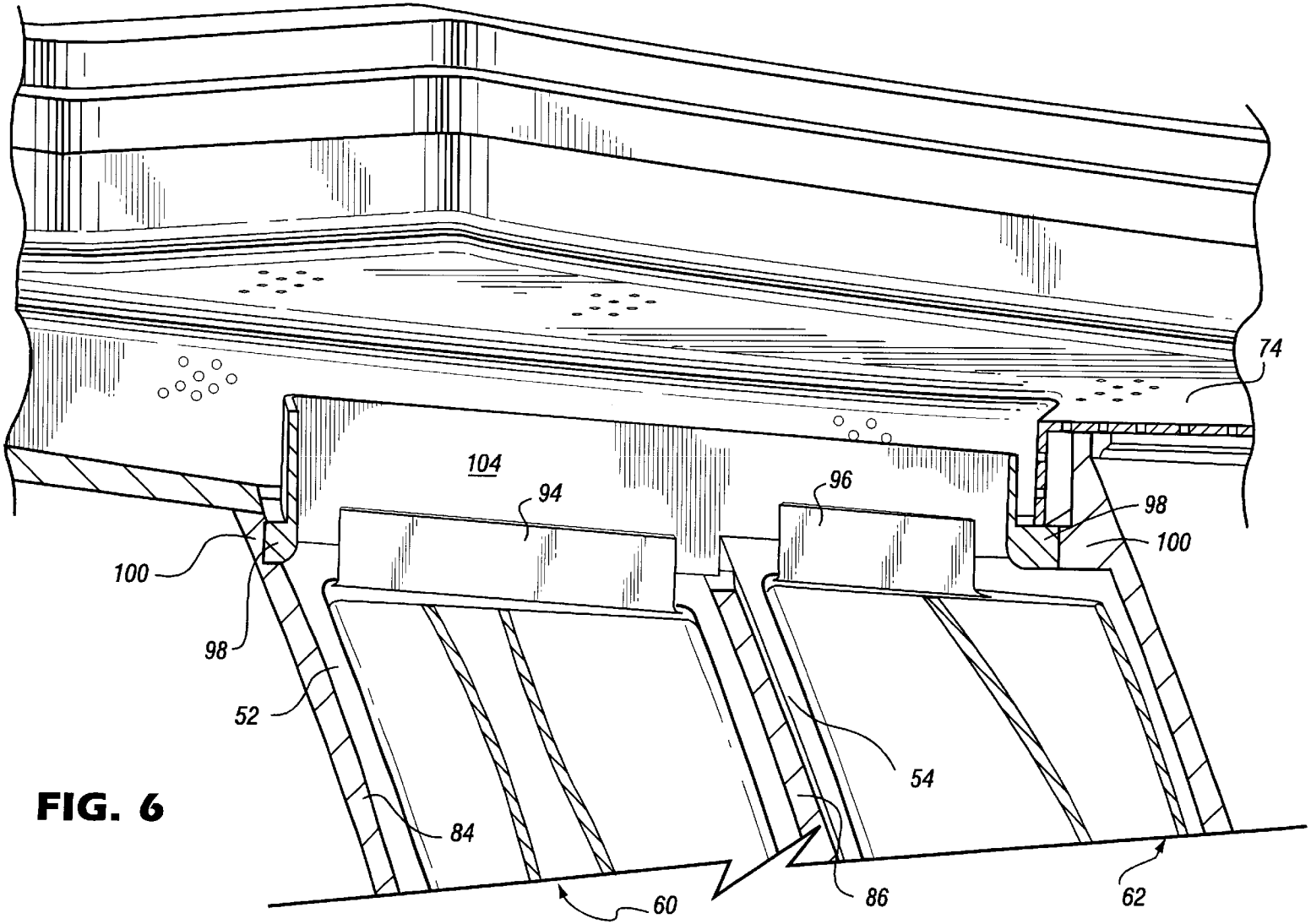
FIG. 6 is a schematic cross-sectional view taken along line A—A of FIG. 5 illustrating a first exemplary embodiment of the invention.
Figure 7:
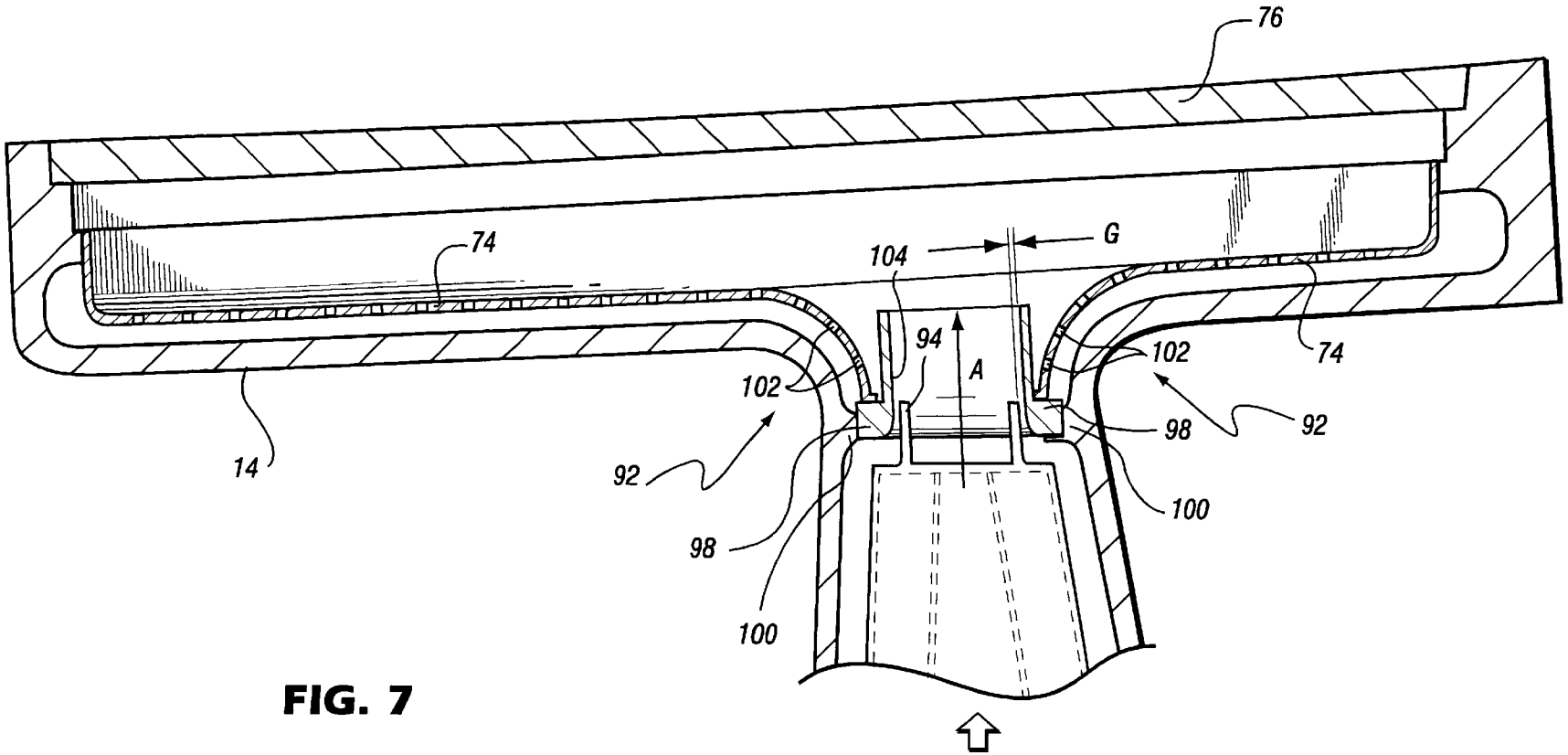
FIG. 7 is a schematic cross-sectional view taken along line B—B of FIG. 5 showing the first exemplary embodiment.
Figure 8:
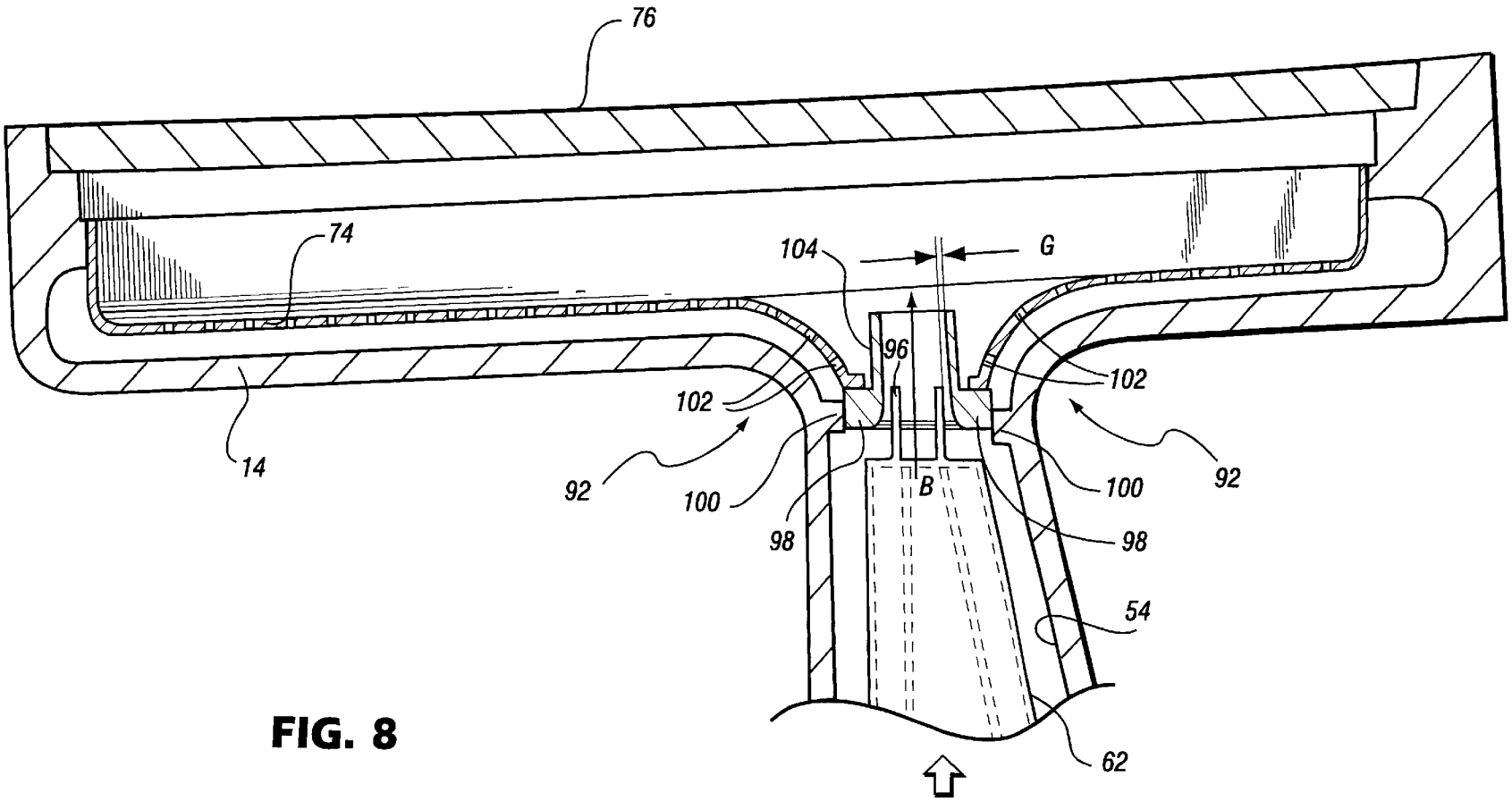
FIG. 8 is a schematic cross-sectional view taken along line C—C of FIG. 5 showing the first embodiment of the invention.

A first embodiment of a fin or skirt extension embodying the invention is shown in the cross-sectional views of FIGS. 6, 7 and 8. As shown, the radially inward end of the sixth cavity insert 60 and the seventh cavity insert 62 each includes a respective fin 94, 96 for directing flow into the plenum 73 at the radially inner end of the vane 10. A flash rib boss 98 is defined at least part peripherally of the opening at the radially inner end of the vane, at the interface of the impingement plate 74 and the flash rib 100. To shield the impingement holes 102 in the aerofoil fillet region 92 from the exit flow, in the first embodiment of the invention a flange or skirt 104 extends radially from the flash rib boss 98.

The configuration of the flash rib/impingement boss and skirt structure for the sixth and seventh cavities can best be seen in FIGS. 7 and 8, respectively, which also show the relationship of the boss/skirt 98, 104 to the impingement plate 74.

With reference to FIG. 7, the impingement boss and skirt are attached to the nozzle flash rib 100 and the skirt 104 extends radially inwardly of the vane to channel exit flow from the respective insert 60, 62 to isolate the same from the impingement openings 102 in the vicinity of the cavity exit ends. As an embodiment of the second aspect of the invention, the flash rib boss 98 defines a prescribed gap G with the adjacent fins 94, 96 of the insert. Gap G is preferably on the order of about 0.02 inches. This controlled gap minimizes the flow of post-impingement steam from the cavity 52, between the cavity fin 94 and the flash rib 100, so that the exit flow is substantially limited to flow via the exit channels 60*b*, 60*a*. Nevertheless, the minimal flow through the gap G will be shielded from the impingement holes 102 in the fillet region 92 by the skirt 104 of the flash rib boss 98. Indeed, the skirt that extends from the flash rib boss channels such gap flow with the flow exiting the vane cavity, shown by arrow A, into the plenum generally radially inwardly of the impingement plate 74 while shielding the impingement holes 102 in the vicinity of the vane cavity from an adverse influence of the steam flow.

FIG. 8 similarly illustrates the provision of a flash rib boss and skirt for channeling flow through the seventh cavity to substantially shield the impingement holes 102 in the vicinity of that cavity from an adverse influence from that exiting flow shown as arrow B. In this embodiment too, the insert 62 of the seventh cavity includes a fin 96 that terminates in a conventional manner in the vicinity of the flash rib 100. The flash rib boss 98 is further provided in this embodiment to define a narrow, controlled gap G to the fin 96 of the insert. A gap of 0.02 inches is provided in the presently preferred embodiment. The flow channeling skirt 104 extending radially inwardly from the flash rib boss 98 again shields the impingement holes 102 in the impingement plate 74 adjacent the nozzle inner side wall from an adverse affect due to the flow exiting from the insert exit channel 62*b* and/or flow between the fin 96 and the flash rib boss 98.

Figure 9:
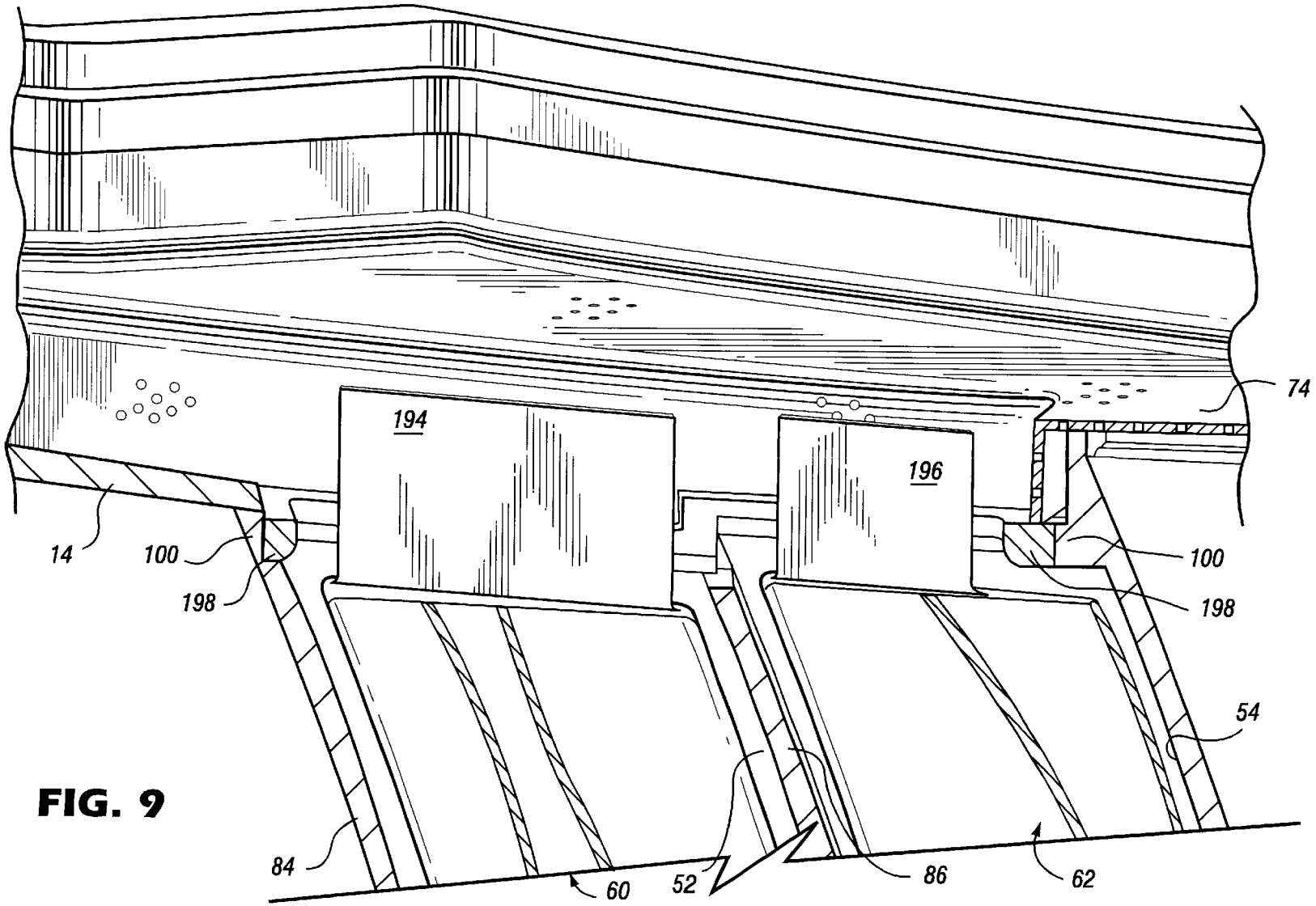
FIG. 9 is a schematic cross-sectional view taken line A—A of FIG. 5 illustrating a second exemplary embodiment of the invention.
Figure 10:
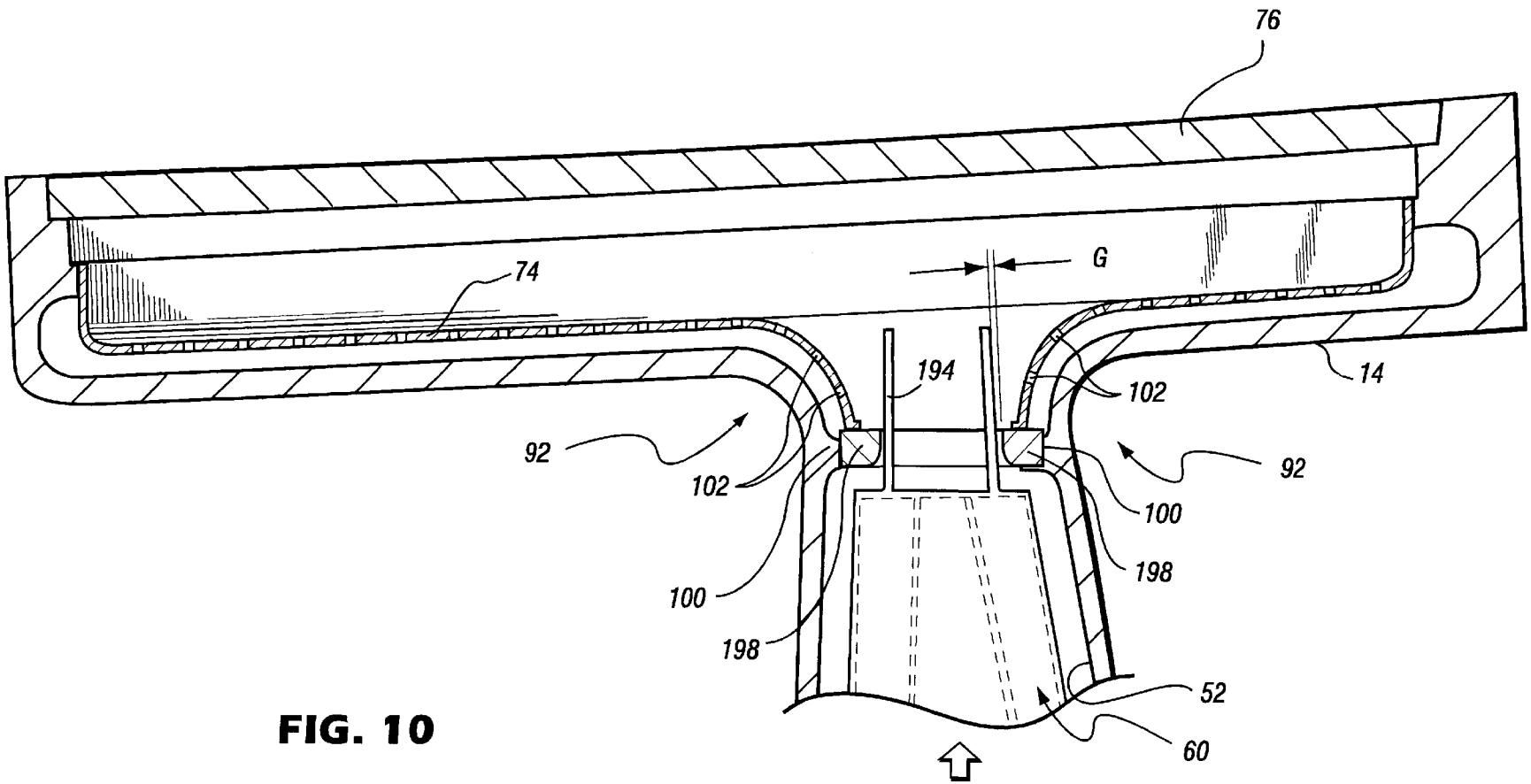
FIG. 10 is a schematic cross-sectional view taken along line B—B of FIG. 5 showing the second embodiment of the invention.
Figure 11:
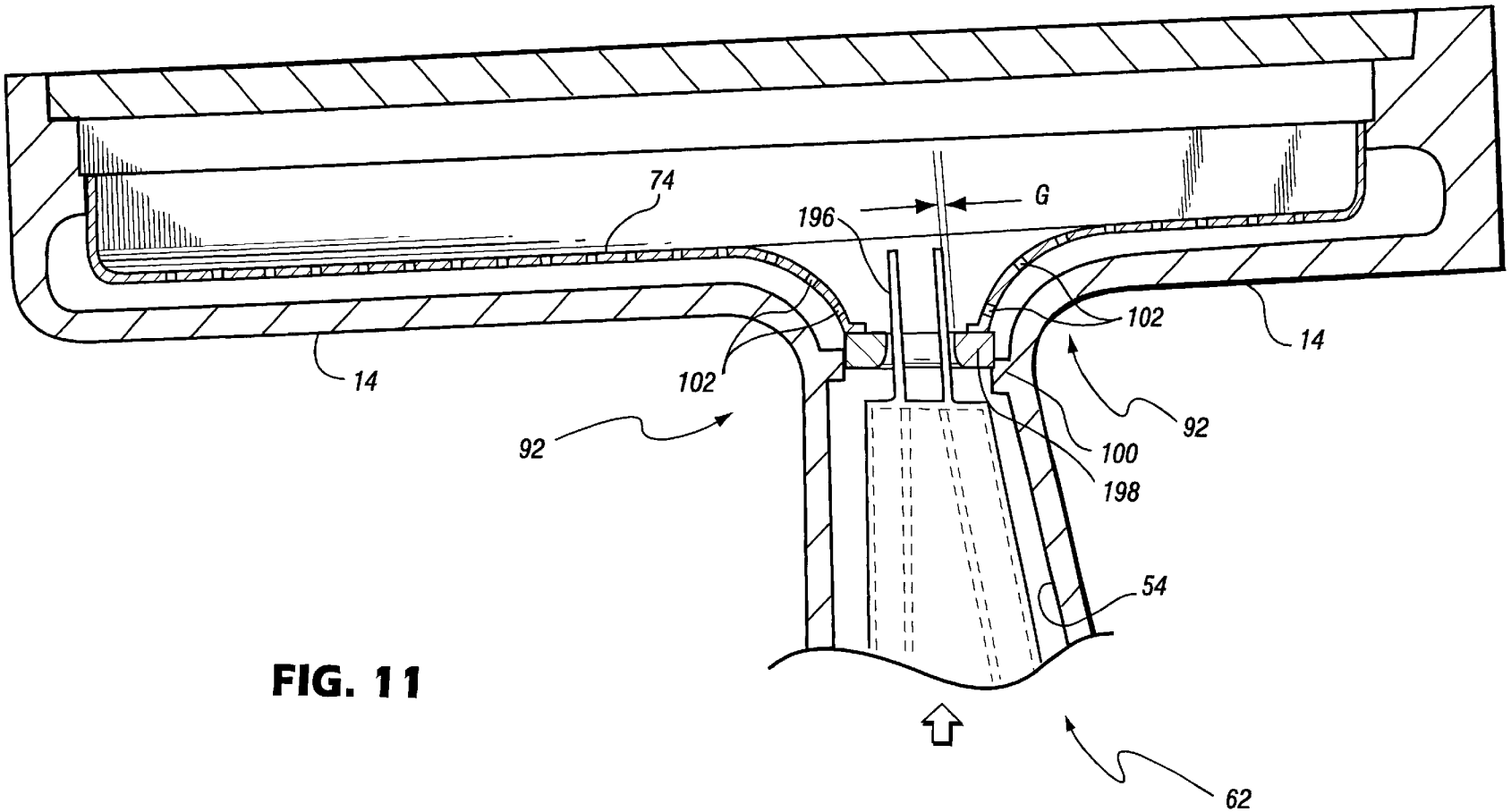
FIG. 11 is a schematic cross-sectional view taken along line C—C of FIG. 5 showing the second embodiment of the invention.

In accordance with a second, alternate embodiment of the invention shown in FIGS. 9–11, the fins 194, 196 of the cavity inserts for the sixth and seventh cavities are extended in a radial direction, longitudinally of the insert, to define flanges for channeling exit flow beyond the fillet region 92 and thereby minimize the exit flow's adverse effect on the impingement holes 102 in the vicinity of the cavity. Thus, in this embodiment, the fins of the cavity insert are extended to act as flow directing flanges or skirts 194, 196 which shield the impingement holes adjacent the cavity and the nozzle inner wall 14. In this embodiment as well, a flash rib boss 198 is provided at the flash rib 100 so as to control the gap between the insert fins, referred to as flanges or skirts in this embodiment, to about 0.02 inches in the presently preferred embodiment. This controlled gap minimizes the flow of post-impingement steam from the cavities 52, 54, between the insert flange 194, 196 and the flash rib boss 98, so that the exit flow is substantially limited to flow via the exit channels 60*b*, 60*a*, 62*b*, where the insert flanges 194, 196 can direct it into the plenum, beyond the fillet region 92.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine vane segment for forming part of a stage of a turbine, comprising:

inner and outer walls spaced from one another;

a turbine vane extending between said inner and outer walls and having leading and trailing edges, said vane including a plurality of discrete cavities between the leading and trailing edges and extending lengthwise of said vane for flowing a cooling medium in a substantially closed circuit through said vane;

an impingement plate mounted to said inner wall in spaced relation to an inner surface thereof, said impingement plate having openings enabling passage of the cooling medium for impingement cooling of said inner wall;

an inner cover plate mounted to said inner wall and spaced from said inner surface with said impingement plate therebetween, thereby to define a plenum of said inner wall between said impingement plate and said cover plate and an impingement gap between said impingement plate and said inner surface, at least one of said cavities of said vane being in communication with said plenum of said inner wall via an opening in said vane, to enable passage of the cooling medium from said at least one cavity into said plenum, and an extension structure for channeling cooling media flow exiting said at least one cavity into said plenum and for substantially shielding at least a portion of said impingement plate adjacent a periphery of said opening from said exiting flow.

2. A turbine vane segment as in claim 1, wherein a flash rib boss is defined at a junction of at least one of said vane and said inner wall with said impingement plate at a radially inner end of said at least one cavity.

3. A turbine vane segment as in claim 2, wherein said flash rib boss includes a radially inwardly extending skirt defining said extension structure for channeling cooling media flow exiting said at least one cavity into said plenum and for substantially shielding at least a portion of said impingement plate disposed adjacent a periphery of said opening from said exiting flow.

4. A turbine vane segment as in claim 1, wherein an insert sleeve is disposed within said at least one cavity and spaced from the inner wall of said vane to define a gap therebetween, said insert having an inlet for flowing the cooling medium into said insert sleeve, said insert sleeve having a plurality of openings therethrough for flowing the cooling medium through said sleeve into said gap for impingement against an inner wall surface of said vane.

5. A turbine vane segment according to claim 4, further including a plurality of cavity ribs projecting inwardly of said interior wall surface at spaced locations along the length of said vane, said insert sleeve engaging said ribs to define gaps between said insert sleeve and said interior wall surface of said vane at spaced locations along said vane.

6. A turbine vane segment according to claim 4, wherein said insert sleeve and said inner wall surface of said vane define a channel therebetween along a side wall of said vane in communication with said gaps for receiving the cooling medium flowing into said gaps.

7. A turbine vane segment according to claim 6, further including a plurality of cavity ribs projecting inwardly of said interior wall surface at spaced locations along the length of said vane, said insert sleeve engaging said ribs to define gaps between said insert sleeve and said interior wall surface of said vane at spaced locations along said vane and wherein said ribs terminate short of fully encompassing said at least one cavity whereby terminal ends of said ribs define ends of said gaps opening into said channel.

8. A turbine vane segment as in claim 4, wherein said insert sleeve further comprises at least one exit flow directing fin at a radially inner end thereof.

9. A turbine vane segment as in claim 8, wherein said at least one exit flow directing fin extends radially substantially beyond a junction of at least one of said vane and said inner wall with said impingement plate at a radially inner end of said at least one cavity, whereby said at least one exit fin defines at least one flange that channels cooling media flow exiting said at least one cavity into said plenum and substantially shields at least a portion of said impingement plate adjacent a periphery of said opening from said exiting flow.

10. A turbine vane segment as in claim 8, further comprising a flash rib boss defined at a junction of at least one of said vane and said inner wall with said impingement plate at a radially inner end of said at least one cavity, and disposed in facing relation to said at least one fin of said insert sleeve.

11. A turbine vane segment as in claim 10, wherein said flash rib boss defines a predetermined gap with said at least one fin of said insert sleeve.

12. A turbine vane segment as in claim 11, wherein said gap is about 0.02 inches.

13. A turbine vane segment as in claim 10, wherein said flash rib boss includes a radially inwardly extending skirt defining said extension structure for channeling cooling media flow exiting said at least one cavity into said plenum and for substantially shielding at least a portion of said impingement plate adjacent a periphery of said opening from said exiting flow.

14. A turbine vane segment as in claim 10, wherein said at least one exit flow directing fin extends radially substantially beyond an interface of said insert sleeve and said flash rib boss, whereby said at least one exit fin defines at least one flange to channel cooling media flow exiting said at least one cavity into said plenum and substantially shield at least a portion of said impingement plate adjacent a periphery of said opening from said exiting flow.

15. A stator vane segment, comprising:

inner and outer walls spaced from one another;

a vane extending between said inner and outer walls and having leading and trailing edges, said vane including a plurality of discrete cavities between the leading and trailing edges and extending lengthwise of said vane for flowing a cooling medium therethrough;

said outer wall defining at least one cooling media plenum;

said inner wall defining at least one cooling media plenum;

a cooling medium inlet enabling passage of the cooling medium into said plenum of said outer wall;

said vane having a first opening communicating said plenum of said outer wall with at least one of said cavities to enable passage of the cooling medium between said one plenum and said one cavity, said vane having a second opening communicating said one cavity with said cooling media plenum of said inner wall, and said vane having a third opening communicating said cooling media plenum of said inner wall with at least another of said cavities to enable passage of the cooling medium in a substantially closed circuit between said cooling media plenum of said outer wall, said one cavity, said cooling media plenum of said inner wall, and said another cavity; and an insert sleeve within each of said one cavity and said another cavity and spaced from interior wall surfaces thereof, each said insert sleeve having an inlet for flowing the cooling medium into said insert sleeve, each said insert sleeve having a plurality of openings therethrough for flowing the cooling medium through said sleeve openings into said space between said sleeve and said interior wall surfaces for impingement against said interior wall surface of said vane;

wherein said inner wall has an impingement plate mounted thereto in spaced relation to an inner surface thereof and a cover spaced from said inner surface with said impingement plate therebetween, thereby to define said plenum of said inner wall between said impingement plate and said cover and an impingement gap between said impingement plate and said inner surface, said second opening of said vane being in communication with said plenum of said inner wall to enable passage of the cooling medium, said impingement plate having openings enabling passage of the cooling medium for impingement cooling of said inner wall, and further comprising an extension structure for channeling cooling media flow exiting said one cavity into said plenum and for substantially shielding a portion of said impingement plate at a periphery of said second opening from said exiting flow.

16. A stator vane segment as in claim 15, wherein a flash rib boss is defined at a junction of at least one of said vane and said inner wall with said impingement plate at a radially inner end of said at least one cavity.

17. A stator vane segment as in claim 16, wherein said flash rib boss includes a radially inwardly extending skirt defining said extension structure for channeling cooling media flow exiting said at least one cavity into said plenum and for substantially shielding at least a portion of said impingement plate disposed adjacent a periphery of said opening from said exiting flow.

18. A stator vane segment according to claim 15, further including a plurality of cavity ribs projecting inwardly of said interior wall surface at spaced locations along the length of said vane, said insert sleeve engaging said ribs to define gaps between said insert sleeve and said interior wall surface of said vane at spaced locations along said vane, said insert sleeve and said inner wall surface of said vane defining a channel therebetween along a side wall of said vane in communication with said gaps for receiving the cooling medium flowing into said gaps.

19. A stator vane segment as in claim 16, wherein said insert sleeve further comprises at least one exit flow directing fin at a radially inner end thereof.

20. A stator vane segment as in claim 19, wherein said at least one exit flow directing fin extends radially substantially beyond said flash rib boss, whereby said at least one extended fin defines said extension structure that channels cooling media flow exiting said at least one cavity into said plenum and substantially shields at least a portion of said impingement plate adjacent a periphery of said opening from said exiting flow.

21. A stator vane segment as in claim 19, wherein said flash rib boss defines a predetermined gap with said at least one fin of said insert sleeve.

22. A stator vane segment as in claim 21, wherein said gap is about 0.02 inches.

23. A stator vane segment as in claim 19, wherein said flash rib boss includes a radially inwardly extending skirt defining said extension structure for channeling cooling media flow exiting said at least one cavity into said plenum and for substantially shielding at least a portion of said impingement plate adjacent a periphery of said opening from said exiting flow.

* * * * *